US009576525B2

(12) United States Patent
Gai et al.

(10) Patent No.: US 9,576,525 B2
(45) Date of Patent: Feb. 21, 2017

(54) AMOLED PIXEL UNIT, METHOD FOR DRIVING THE SAME, AND DISPLAY DEVICE

(71) Applicant: BOE TECHNOLOGY GROUP CO., LTD., Beijing (CN)

(72) Inventors: Cuili Gai, Beijing (CN); Danna Song, Beijing (CN); Zhongyuan Wu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 399 days.

(21) Appl. No.: 14/347,369

(22) PCT Filed: May 15, 2013

(86) PCT No.: PCT/CN2013/075647

§ 371 (c)(1),
(2) Date: Mar. 26, 2014

(87) PCT Pub. No.: WO2014/153815

PCT Pub. Date: Oct. 2, 2014

(65) Prior Publication Data

US 2016/0171928 A1 Jun. 16, 2016

(30) Foreign Application Priority Data

Mar. 25, 2013 (CN) ..... 2013 1 0097307

(51) Int. Cl.
*G09G 3/3225* (2016.01)
*G09G 3/32* (2016.01)

(52) U.S. Cl.
CPC ..... *G09G 3/3225* (2013.01); *G09G 3/3233* (2013.01); *G09G 2300/0814* (2013.01);
(Continued)

(58) Field of Classification Search
CPC ..... G09G 3/3225; G09G 3/3233; G09G 2300/0842; G09G 2310/0262; G09G 2320/0204; G09G 2320/0233; G09G 2320/0257; G09G 2320/045; G09G 2300/0814; G09G 2300/0819
(Continued)

(56) References Cited

U.S. PATENT DOCUMENTS 7,911,427 B2 * 3/2011 Chung ..... G09G 3/3233 315/169.3
7,944,418 B2 * 5/2011 Chung ..... G09G 3/3233 315/169.3
(Continued)

FOREIGN PATENT DOCUMENTS

CN 102930821 A 2/2013
CN 102930822 A 2/2013
CN 203179475 A 9/2013
KR 100947992 B1 3/2010

OTHER PUBLICATIONS

International Preliminary Report on Patentability Appln. No. PCT/CN2013/075647; Dated Sep. 29, 2015.
(Continued)

*Primary Examiner* — Dmitriy Bolotin
(74) *Attorney, Agent, or Firm* — Ladas & Parry LLP

(57) ABSTRACT

Provided are an AMOLED pixel unit, a method for driving the same, and a display device. The AMOLED pixel unit includes a compensating unit, a light emitting control unit, a driving transistor, a storage capacitor and an organic light emitting diode, wherein the compensating unit is switched on under the control of a signal on a scan line; the light emitting control unit is switched on under the control of a signal on a light emitting control line; an anode of the organic light emitting diode is connected to a second terminal of the storage capacitor, and a cathode of the organic light emitting diode receives a second power supply signal.
(Continued)

Such a circuit can effectively compensate for the drift and the non-uniformity of the threshold voltages of the transistors and the non-uniformity of the voltages of the organic light emitting diodes.

15 Claims, 3 Drawing Sheets

(52) U.S. Cl.
CPC ..... *G09G 2300/0819* (2013.01); *G09G 2300/0842* (2013.01); *G09G 2310/0262* (2013.01); *G09G 2320/0204* (2013.01); *G09G 2320/0233* (2013.01); *G09G 2320/0257* (2013.01); *G09G 2320/045* (2013.01)

(58) Field of Classification Search
USPC ..... 345/76, 77, 78, 82, 92, 173, 174, 175, 345/205, 207, 211, 212, 213, 214, 6, 90, 345/698
See application file for complete search history.

(56) References Cited

U.S. PATENT DOCUMENTS

| | | | | |
|---|---|---|---|---|
| 8,159,422 | B2 * | 4/2012 | Abe | G09G 3/2011 345/76 |
| 8,659,511 | B2 * | 2/2014 | Ryu | G09G 3/3233 345/76 |
| 2012/0287103 | A1 * | 11/2012 | Wu | G09G 3/3233 345/211 |
| 2014/0132642 | A1 * | 5/2014 | Wu | G09G 3/3233 345/690 |
| 2015/0379956 | A1 * | 12/2015 | Nonaka | G09G 3/3233 315/172 |

OTHER PUBLICATIONS

First Chinese Office Action dated Sep. 2, 2014; Appln. No. 201310097307.3.
International Search Report mailed Feb. 1, 2014; PCT/CN2013/075647.

* cited by examiner

AMOLED PIXEL UNIT, METHOD FOR DRIVING THE SAME, AND DISPLAY DEVICE

TECHNICAL FIELD OF THE DISCLOSURE

The present disclosure relates to a field of display technology, and particularly to an AMOLED pixel unit, a method for driving the same, and a display device.

BACKGROUND

Organic light emitting diodes (OLED) have been increasingly used as current-type light-emitting devices in high-performance Active Matrix Organic Light Emitting Diode displays. With increasing of display size, conventional passive matrix organic light emitting diode displays require a shorter driving time for a single pixel, and thus require an increased transient current, which causes increased power consumption. Meanwhile, a voltage drop on a line of nanometer indium tin oxide (ITO) will be too large when a large current is applied, such that an operating voltage of OLED is too high and efficiency of OLED is decreased. The currents for OLEDs are input to active-matrix organic light-emitting diode displays when switching transistors are scanned progressively, which can solve the above problems well.

In design of an AMOLED backboard, a main problem to be solved is non-uniformity of luminance among respective pixels of AMOLED.

First, for AMOLED, pixel circuits are constituted by thin film transistors to supply currents for driving OLED devices, respectively. In prior art, Low-temperature poly-silicon thin film transistors (LTPS TFT) or oxide thin film transistor (Oxide TFT) are mostly adopted. Compared to a general amorphous silicon thin film transistor (amorphous-Si TFT), LTPS TFT and Oxide TFT have higher mobility and more stable characteristics, and thus are more suitable for AMOLED display. However, due to limitations of the crystallization process, LTPS TFTs produced on a large-area glass substrate often have non-uniformity on electrical parameters such as threshold voltage, mobility and the like, and such non-uniformity may cause current difference and luminance difference among OLED devices, that is, a mura phenomena occurs, which may be perceived by human eyes. Although process of Oxide TFTs achieves a better uniformity, similar to a-Si TFTs, a threshold voltage of Oxide TFT may drift under a high temperature or supplied with a voltage for a long time. Due to different images as displayed, drifts of threshold voltages of TFTs in respective areas on a panel may be different from each other, which may cause display luminance difference, such display luminance difference often renders in turn an image sticking phenomenon since such display luminance difference has a relation to a previously displayed image.

Second, in large-size display applications, since a certain resistance exists in a power supply line on the backboard, and driving currents for all pixels are supplied from an ARVDD power supply, a supply voltage for an area near to a location of the ARVDD power supply is higher than a supply voltage for an area far from the location, such a phenomenon is known as a voltage drop of the power supply (IR Drop). As the voltage of the ARVDD power supply has a relation to currents in different areas, IR drop may also cause driving current differences in different areas, and thus a mura phenomenon appears during display. LTPS process for constructing pixel units by adopting P-type TFTs is sensitive to such an IP drop since a storage capacitor therein is connected between the ARVDD and a gate of TFT, and thus voltage variation of ARVDD may directly affect a gate-source voltage Vgs for driving the TFT.

Third, the non-uniformity of the electrical characteristics of the OLED devices may also be resulted from non-uniform thickness of the mask during an evaporation process. For the a-Si or Oxide TFT process constructing pixel units by adopting N-type TFTs, a storage capacitor therein is connected between a gate of a driving TFT and an anode of the light-emitting device, if voltages at the anodes of the OLED devices of respective pixels are different when a data voltage is transmitted to the gates, the gate-source voltages Vgs actually applied to the TFTs may be different, so that display luminance are different due to different driving currents.

In prior art, an AMOLED voltage-type pixel unit driving circuit is provided, and a voltage-type driving method is similar to a conventional AMLCD driving method, wherein a voltage signal representative of a gray scale is supplied from a driving unit, and the voltage signal is converted to a current signal for a driving transistor inside the pixel circuit so as to drive OLED to achieve the luminance corresponding to the gray scale. Such a method has advantages of fast driving speed and simple implementation, is suitable to be used in the driving of a large size panel, and is thus widely adopted in display industry. However, it is necessary to design additional devices comprising TFTs and capacitors to compensate for non-uniformity of TFTs, IR Drop and non-uniformity of OLEDs.

As shown in FIG. 1, a conventional circuit configuration of a voltage-driven type pixel unit adopts two TFTs and a capacitor (2T1C), wherein a data voltage on a data line is transmitted to a gate of a driving transistor TQ through a switching transistor TK and is then converted into a corresponding current by the driving transistor TQ for being supplied to an OLED device. In normal operation, the driving transistor TQ is in a saturation region and provides a constant current during a scanning period for a row of pixels. The current may be represented as:

$$I_{OLED} = \frac{1}{2}\mu_n \cdot Cox \cdot \frac{W}{L} \cdot (Vdata - Voled - Vthn)^2$$

Wherein, for all pixel units, $\mu_n$ represents a carrier mobility, Cox represents a gate oxide layer capacitance, W/L represents a width/length ratio of a channel of a transistor, Vdata represents a data voltage, Voled represents an operating voltage of OLED, Vthn represents a threshold voltage of the transistor, wherein Vthn has a positive value when the transistor is an enhanced TFT and has a negative value when the transistor is a depleted TFT.

Although the pixel unit driving circuit in the prior art has been widely used, it has the following problems inevitably: there is difference among currents in different pixel units if the different pixel units have different Vthn; in addition, if Vthn in a pixel unit drifts with elapse of time, the current may vary with time, thus rendering an image sticking; moreover, the non-uniformity of the OLED devices will render different operating voltages of the OLED devices, which may also contribute to the difference among currents of different pixel units.

SUMMARY

Technical problems to be solved in embodiments of the present disclosure include instability of an existing pixel unit driving circuit caused by non-uniformity of threshold voltages of thin film transistors and non-uniformity of organic light emitting diodes among different pixel units of the existing pixel unit driving circuit, which may render poor uniformity of picture displayed by an organic light emitting display and poor light emitting quality of the organic light emitting display. In the embodiments of the present disclosure, there is provided an AMOLED pixel unit, a method for driving the same, and a display device capable of effectively compensating for the non-uniformity of the threshold voltages of the thin film transistors and the non-uniformity of the organic light emitting diodes so as to improve the uniformity of the picture displayed by the organic light emitting display.

Technical solutions of the embodiments of the present disclosure provide an AMOLED pixel unit including a compensating unit, a light emitting control unit, a driving transistor, a storage capacitor and an organic light emitting diode, wherein the compensating unit is switched on under the control of a signal on a scan line, transmits a signal on a data line to a gate and a first electrode of the driving transistor, and meanwhile transmits a reference power supply signal to a first terminal of the storage capacitor; the light emitting control unit is switched on under the control of a signal on a light emitting control line, transmits a first power supply signal to the first electrode of the driving transistor, and meanwhile establishes a path between the first terminal of the storage capacitor and the gate of the driving transistor to drive the organic light emitting diode to emit light; an anode of the organic light emitting diode is connected to a second terminal of the storage capacitor, and a cathode of the organic light emitting diode receives a second power supply signal.

In the AMOLED pixel unit of the embodiments of the present disclosure, the compensating unit is used to compensate for the non-uniformity caused by drifts of the threshold voltages of the driving transistors; meanwhile a voltage difference may be maintained through bootstrapping effect of the storage capacitor, such that effect of the non-uniformity of the electric properties of organic light emitting diodes may be avoided.

Optionally, the compensating unit includes: a first switching transistor, a third switching transistor, and a fifth switching transistor; wherein a gate of the first switching transistor receives the signal on the scan line, a first electrode of the first switching transistor receives the signal on the data line, and a second electrode of the first switching transistor is connected to a first electrode the third switching transistor and the first electrode of the driving transistor; a gate of the third switching transistor receives the signal on the scan line, and a second electrode of the third switching transistor is connected to the gate of the driving transistor and the light emitting control unit; a gate of the fifth switching transistor receives the signal on the scan line, a first electrode of the fifth switching transistor is connected to a reference power supply, and a second electrode of the fifth switching transistor is connected to the first terminal of the storage capacitor and the light emitting control unit.

Optionally, the light emitting control unit includes a second switching transistor and a fourth switching transistor; wherein a first electrode of the second switching transistor receives the first power supply signal, a gate of the second switching transistor receives the signal on the light emitting control line, and a second electrode of the second switching transistor is connected to the first electrode of the driving transistor; a first electrode of the fourth switching transistor is connected to the second electrode of the third switching transistor and the gate of the driving transistor, a gate of the fourth switching transistor receives the signal on the light emitting control line, and a second electrode of the fourth switching transistor is connected to the first terminal of the storage capacitor and the second electrode of the fifth switching transistor.

As an optional solution, in the AMOLED pixel unit described above, the first power supply signal is an operating voltage for light emitting ELVDD, the second power supply signal is an earth voltage for light emitting ELVSS, and a high level of ELVSS is higher than a driving voltage corresponding to a highest gray scale of OLED.

Optionally, the first switching transistor, the second switching transistor, the third switching transistor, the fourth switching transistor, the fifth switching transistor and the driving transistor are selected individually from any one of a poly silicon TFT, amorphous silicon TFT, Oxide TFT and Organic TFT.

Optionally, all of the first switching transistor, the second switching transistor, the third switching transistor, the fourth switching transistor, the fifth switching transistor and the driving transistor are N type TFTs, wherein the first electrodes thereof are drains and the second electrode thereof are sources.

According to the embodiments of the present disclosure, there is provided a method for driving the above-described AMOLED pixel unit including the steps of:

during a compensating phase, activating the signal on the scan line to switch on the compensating unit, such that the signal on the data line is transmitted to the gate and the first electrode of the driving transistor and the reference power supply signal is transmitted to the first terminal of the storage capacitor at the same time;

during a light emitting phase, activating the signal on the light emitting control line and deactivating the signal on the scan line to switch on the light emitting control unit, such that the first power supply signal is transmitted to the first electrode of the driving transistor and the first terminal of the storage capacitor is connected to the gate of the driving transistor, the organic light emitting diode is driven to emit light.

The above-described method for driving the AMOLED pixel unit of the embodiments of the present disclosure includes two phases: the compensating phase and the light emitting phase, wherein the method uses fewer control signals, has simpler timing sequence in control, and thus can be implemented easily.

Optionally, the above-described method for driving the AMOLED pixel unit includes: in a case that the first switching transistor, the second switching transistor, the third switching transistor, the fourth switching transistor, the fifth switching transistor and the driving transistor are N type TFTs, during the compensating phase, the signal on the scan line being at a high level to turn on the first switching transistor, the third switching transistor and the fifth switching transistor, such that the driving transistor is charged by the signal on the data line, and a voltage of the first terminal of the storage capacitor is set to a voltage of the reference power supply signal by a reference power supply;

during the light emitting phase, the signal on the light emitting control line being at a high level to turn on the second switching transistor and the fourth switching transistor, and the scan line being at a low level, such that the storage capacitor keeps its stored electric charges unchanged and the driving transistor drives the organic light emitting diode to emit light.

In the embodiments of the present disclosure, there is provided a display device including the above-described AMOLED pixel unit.

Since the display device of the embodiments of the present disclosure includes the above-described pixel unit, the uniformity of picture displayed on the display device may be improved significantly.

REFERENCE SIGNS

TQ—driving transistor; TK—switching transistor; T1—first switching transistor; T2—second switching transistor; T3—third switching transistor, T4—driving transistor; T5—fourth switching transistor; T6—fifth switching transistor; C—storage capacitor; OLED—organic light emitting diode; VREF—reference power supply signal; EM—light emitting control line; Scan—scan line, DATA—data line.

DETAILED DESCRIPTION

The present disclosure will be described in detail in combination with accompanying drawings and particular implementations of the present disclosure below so that those skilled in the art can understand the technical solutions of the present disclosures well.

First Embodiment

In the present embodiment, there is provided an AMOLED pixel unit including a compensating unit, a light emitting control unit, a driving transistor T4, a storage capacitor C and an organic light emitting diode OLED, wherein the compensating unit is switched on under the control of a signal on a scan line Scan, transmits a signal on a data line DATA to a gate and a first electrode of the driving transistor T4, and meanwhile transmits a reference power supply signal VREF to a first terminal of the storage capacitor C; the light emitting control unit is switched on under the control of a signal on a light emitting control line EM, transmits a first power supply signal to the first electrode of the driving transistor T4, and meanwhile establishes a path between the first terminal of the storage capacitor C and the gate of the driving transistor T4 to drive the organic light emitting diode OLED to emit light; an anode of the organic light emitting diode OLED is connected to a second terminal of the storage capacitor C, and a cathode of the organic light emitting diode OLED receives a second power supply signal.

With the AMOLED pixel unit with such a configuration, a threshold voltage of the driving transistor T4 may be compensated by the compensating unit, such that the uniformity of the organic light emitting diodes OLED will be not affected by drift of the threshold voltage of the driving transistor T4. In addition, the AMOLED pixel unit with such a configuration may be applied widely due to fewer control signals, simpler timing sequences, and the like.

Figure 1:
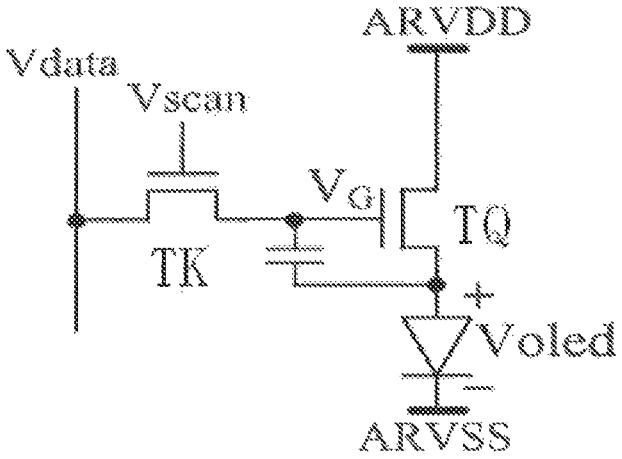
Fig.1 (Prior Art)
FIG. 1 is a principle diagram of a pixel unit of an existing AMOLED display device.
Figure 2:
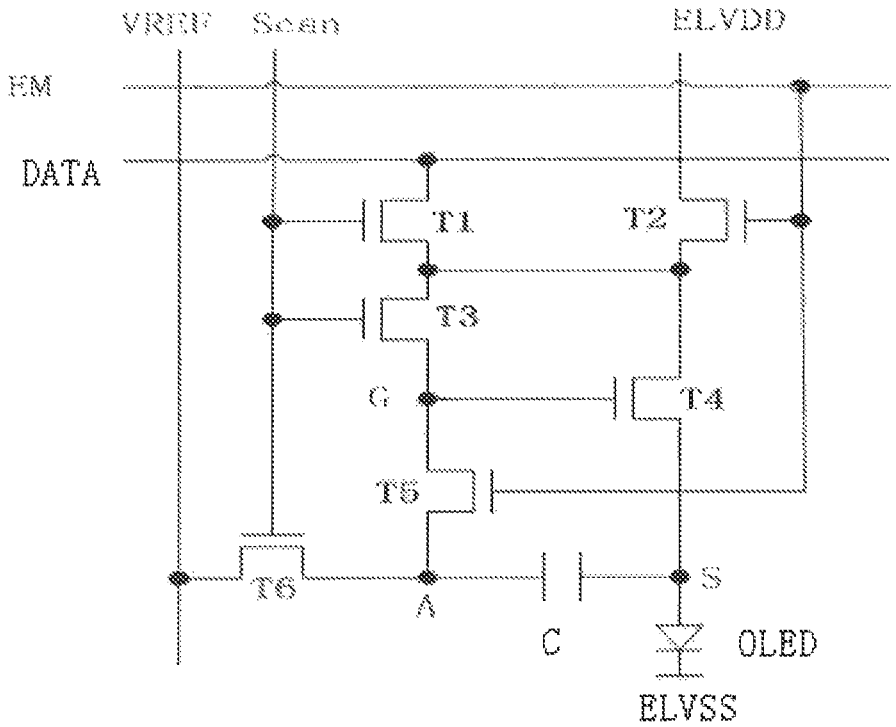
FIG. 2 is a principle diagram of a pixel unit of a display device according to a first embodiment of the present disclosure.

As shown in FIG. 2, optionally, the compensating unit includes: a first switching transistor T1, a third switching transistor T3, and a fifth switching transistor T6; wherein a gate of the first switching transistor T1 receives the signal on the scan line Scan, a first electrode of the first switching transistor T1 receives the signal on the data line DATA, and a second electrode of the first switching transistor T1 is connected to a first electrode of the third switching transistor T3 and the first electrode of the driving transistor T4; a gate of the third switching transistor T3 receives the signal on the scan line Scan, and a second electrode of the third switching transistor T3 is connected to the gate of the driving transistor T4 and the light emitting control unit; a gate of the fifth switching transistor T6 receives the signal on the scan line Scan, a first electrode of the fifth switching transistor T6 is connected to a reference power supply, and a second electrode of the fifth switching transistor T6 is connected to the first terminal of the storage capacitor C and the light emitting control unit.

Further, optionally, the light emitting control unit includes a second switching transistor T2 and a fourth switching transistor T5; wherein a first electrode of the second switching transistor T2 receives the first power supply signal, a gate of the second switching transistor T2 receives the signal on the light emitting control line EM, and a second electrode of the second switching transistor T2 is connected to the first electrode of the driving transistor T4; a first electrode of the fourth switching transistor T5 is connected to the second electrode of the third switching transistor T3 and the gate of the driving transistor T4, a gate of the fourth switching transistor T5 receives the signal on the light emitting control line EM, and a second electrode of the fourth switching transistor T5 is connected to the first terminal of the storage capacitor C and the second electrode of the fifth switching transistor T6.

In the AMOLED pixel unit described above, the first power supply signal is an operating voltage for light emitting ELVDD, the second power supply signal is an earth voltage for light emitting ELVSS, and a high level of ELVSS is higher than a driving voltage corresponding to a highest gray scale of OLED.

Further, optionally, the first switching transistor T1, the second switching transistor T2, the third switching transistor T3, the fourth switching transistor T5, the fifth switching transistor T6 and the driving transistor T4 are selected individually from any one of poly silicon TFT, amorphous silicon TFT, Oxide TFT and Organic TFT; and all of them are N type TFTs, wherein the first electrodes thereof are drains and the second electrode thereof are sources.

Second Embodiment

In the present embodiment of the present disclosure, there is provided a method for driving the above-described AMOLED pixel unit, wherein the method including the following two steps:

during a compensating phase, activating the signal on the scan line Scan to switch on the compensating unit, such that the signal on the data line DATA is transmitted to the gate and the first electrode of the driving transistor T4 and the reference power supply signal VREF is transmitted to the first terminal of the storage capacitor C at the same time;

during a light emitting phase, activating the signal on the light emitting control line EM and deactivating the signal on the scan line Scan to switch on the light emitting control unit, such that the first power supply signal ELVDD is transmitted to the first electrode of the driving transistor T4 and the first terminal of the storage capacitor C is connected to the gate of the driving transistor T4, and the organic light emitting diode OLED is driven to emit light.

Wherein the compensating unit includes a first switching transistor T1, a third switching transistor T3 and a fifth switching transistor T6; the light emitting control unit includes a second switching transistor T2 and a fourth switching transistor T5.

Below, the operational process of the AMOLED pixel unit will be described in detail.

Figure 3:
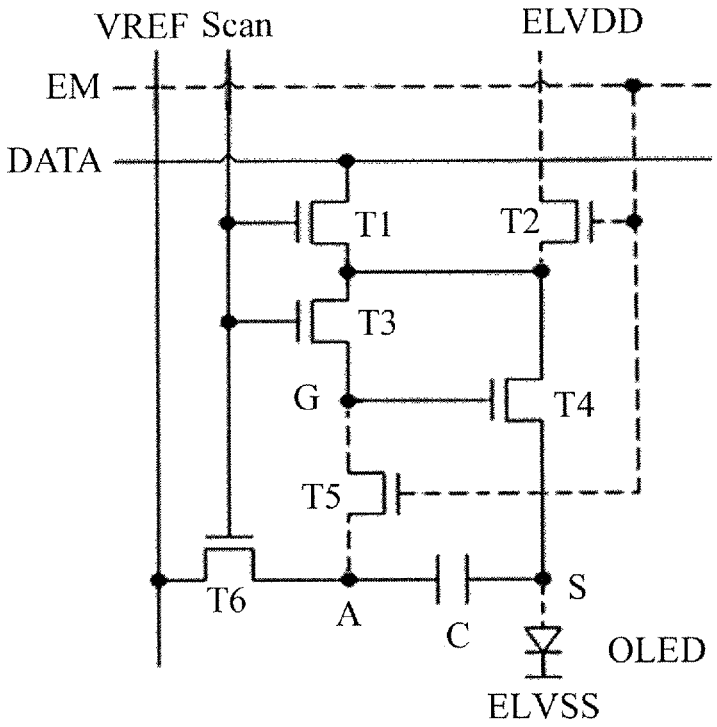
FIG. 3 is a schematic diagram of an operational principle of a compensating phase of a pixel unit of a display device according to a second embodiment of the present disclosure.

In combination with FIG. 3, a first phase is the compensating phase, when the signal on the scan line Scan is activated, that is, when a scan control signal Vscan corresponding to the scan line Scan is at a high level, the first switching transistor T1, the third switching transistor T3, the driving transistor T4, and the fifth switching transistor T6 are turned on; a light emitting control signal VEM corresponding to the light emitting control line EM is at a low level, the second switching transistor T2 and the fourth switching transistor T5 are turned off, a data line signal corresponding to the data line DATA is a data voltage VDATA of the present frame, ELVSS is at a high level. At this time, the reference power supply signal VREF may reset a potential at a point A to be a voltage of the reference power supply signal VREF through the fifth switching transistor T6. A voltage at a point G is charged to VDATA through the turned-on first switching transistor T1 and third switching transistor T3. The driving transistor T4 is equivalent to a PN junction when it is turned on, so a voltage at a point S is charged to VDATA−Vth. It should be guaranteed that a high level of ELVSS is higher than a driving voltage corresponding to a highest gray scale, because the organic light emitting diode OLED would emit light if the high level of ELVSS is lower than the driving voltage corresponding to the highest gray scale. At the end of the compensating phase, electronic charges across two terminals of the storage capacitor C is (VREF−VDATA+Vth)*CST.

Figure 4:
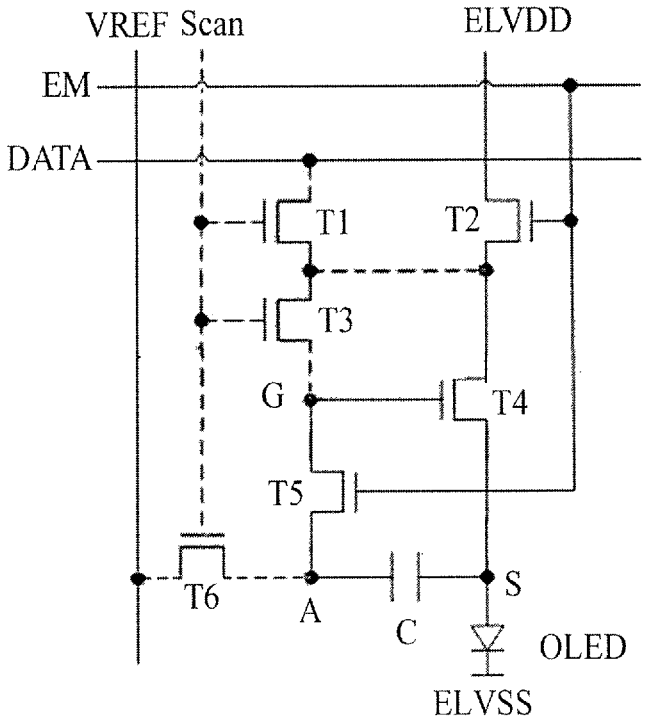
FIG. 4 is a schematic diagram of an operational principle of a light emitting phase of the pixel unit of the display device according to the second embodiment of the present disclosure.

In combination with FIG. 4, a second phase is the light emitting phase, when the light emitting control line EM is activated, that is, when the light emitting control signal VEM corresponding to the light emitting control line is at a high level, the second switching transistor T2 and the fourth switching transistor T5 are turned on; the scan control signal Vscan corresponding to the scan line is at a low level, the first switching transistor T1, the third switching transistor T3, the driving transistor T4, and the fifth switching transistor T6 are turned off, the second power supply signal ELVSS is at a low level. At this time, the storage capacitor C is connected between the gate and the source of the driving transistor T4 to maintain the gate-source voltage Vgs of the driving transistor T4, and the electronic charges stored therein is kept unchanged; the voltage across the two terminals of the organic light emitting diode OLED becomes VOLED with the stabilization of the current of the organic light emitting diode OLED, the voltage at the point S becomes ELVSS+VOLED, and the voltage at the points A and G becomes VREF+VOLED+ELVSS−VDATA+Vth due to the bootstrapping effect of the storage capacitor C. The gate-source voltage Vgs of the driving transistor T4 is maintained to be VREF-VDATA+Vth, and at this time the current flowing through the driving transistor T4 is:

$$I_{OLED} = \frac{1}{2}\mu_n \cdot Cox \cdot \frac{W}{L} \cdot (VREF - V_{DATA} + Vth - Vth)^2 = \frac{1}{2}\mu_n \cdot Cox \cdot \frac{W}{L} \cdot (VREF - V_{DATA})^2$$

It can be seen from the above equation that the current has no relation to the threshold voltage and the voltage across the two terminals of the organic light-emitting diode OLED, and the effect of the non-uniformity of the threshold voltage, the drift of the threshold voltage and the non-uniformity of the electric characteristics of the organic light emitting diodes OLED will be eliminated basically.

Figure 5:
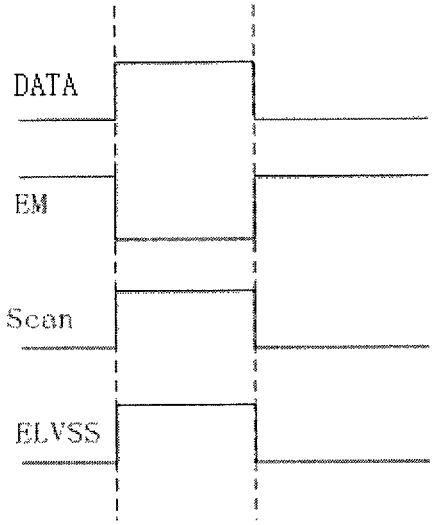
FIG. 5 is an operational timing diagram of the pixel unit of the display device according to the second embodiment of the present disclosure.

FIG. 5 shows a timing diagram of the pixel circuit. From the timing diagram, it can be seen that the number of control signals used is small, the timing sequence of the circuit is simple and can be implemented easily, so the pixel circuit may be applied widely.

Third Embodiment

In the present embodiment, there is provided a display device including the AMOLED pixel unit as described in the first embodiment, details omitted.

The display device of the present embodiment may be any product or mean with a display function, such as, an OLED panel, a mobile phone, a tablet computer, a television, a display, a notebook computer, a digital photo frame, a navigator and so on.

Of course, the display device in the present embodiment further has structures such as an outside bezel of a conventional AMOLED display device.

The uniformity of picture displayed on the display device of the present embodiment is improved significantly, since the display device of the present embodiment includes the AMOLED pixel unit in the first embodiment.

It should be understood that the above descriptions are only for illustrating the embodiments of the present disclosure, and will make no limitation to the present disclosure. Those skilled in the art may make modifications, variations, equivalences and improvements on the above embodiments without departing from the spirit and essential of the present disclosure. These modifications, variations, equivalences and improvements are intended to be included in the protection scope of the present disclosure.

What is claimed is:

1. An AMOLED pixel unit comprising a compensating unit, a light emitting control unit, a driving transistor, a storage capacitor and an organic light emitting diode, wherein:

the compensating unit is switched on under a control of a signal on a scan line, transmits a signal on a data line to a gate and a first electrode of the driving transistor, and meanwhile transmits a reference power supply signal to a first terminal of the storage capacitor;

the light emitting control unit is switched on under a control of a signal on a light emitting control line, transmits a first power supply signal to the first electrode of the driving transistor, and meanwhile connects the first terminal of the storage capacitor to the gate of the driving transistor to drive the organic light emitting diode to emit light; and an anode of the organic light emitting diode is connected to a second terminal of the storage capacitor, and a cathode of the organic light emitting diode receives a second power supply signal.

2. The AMOLED pixel unit according to claim 1, wherein the compensating unit comprises: a first switching transistor, a third switching transistor, and a fifth switching transistor; wherein a gate of the first switching transistor receives the signal on the scan line, a first electrode of the first switching transistor receives the signal on the data line, and a second electrode of the first switching transistor is connected to a first electrode the third switching transistor and the first electrode of the driving transistor;

a gate of the third switching transistor receives the signal on the scan line, and a second electrode of the third switching transistor is connected to the gate of the driving transistor and the light emitting control unit;

a gate of the fifth switching transistor receives the signal on the scan line, a first electrode of the fifth switching transistor is connected to the reference power supply, and a second electrode of the fifth switching transistor is connected to the first terminal of the storage capacitor and the light emitting control unit.

3. The AMOLED pixel unit according to claim 2, wherein the light emitting control unit comprises a second switching transistor and a fourth switching transistor; wherein a first electrode of the second switching transistor receives the first power supply signal, a gate of the second switching transistor receives the signal on the light emitting control line, and a second electrode of the second switching transistor is connected to the first electrode of the driving transistor;

a first electrode of the fourth switching transistor is connected to the second electrode of the third switching transistor and the gate of the driving transistor, a gate of the fourth switching transistor receives the signal on the light emitting control line, and a second electrode of the fourth switching transistor is connected to the first terminal of the storage capacitor and the second electrode of the fifth switching transistor.

4. The AMOLED pixel unit according to claim 3, wherein the first power supply signal is an operating voltage for light emitting ELVDD, the second power supply signal is an earth voltage for light emitting ELVSS, and a high level of ELVSS is higher than a driving voltage corresponding to a highest gray scale of OLED.

5. The AMOLED pixel unit according to claim 3, wherein the first switching transistor, the second switching transistor, the third switching transistor, the fourth switching transistor, the fifth switching transistor and the driving transistor are selected individually from any one of a poly silicon TFT, amorphous silicon TFT, Oxide TFT and Organic TFT.

6. The AMOLED pixel unit according to claim 3, wherein the first switching transistor, the second switching transistor, the third switching transistor, the fourth switching transistor, the fifth switching transistor and the driving transistor are N type TFTs, wherein the first electrode is a drain and the second electrode is a source.

7. A display device, including the AMOLED pixel unit according to claim 1.

8. The display device according to claim 7, wherein the compensating unit comprises: a first switching transistor, a third switching transistor, and a fifth switching transistor; wherein a gate of the first switching transistor receives the signal on the scan line, a first electrode of the first switching transistor receives the signal on the data line, and a second electrode of the first switching transistor is connected to a first electrode the third switching transistor and the first electrode of the driving transistor;

a gate of the third switching transistor receives the signal on the scan line, and a second electrode of the third switching transistor is connected to the gate of the driving transistor and the light emitting control unit;

a gate of the fifth switching transistor receives the signal on the scan line, a first electrode of the fifth switching transistor is connected to the reference power supply, and a second electrode of the fifth switching transistor is connected to the first terminal of the storage capacitor and the light emitting control unit.

9. The display device according to claim 8, wherein the light emitting control unit comprises a second switching transistor and a fourth switching transistor; wherein a first electrode of the second switching transistor receives the first power supply signal, a gate of the second switching transistor receives the signal on the light emitting control line, and a second electrode of the second switching transistor is connected to the first electrode of the driving transistor;

a first electrode of the fourth switching transistor is connected to the second electrode of the third switching transistor and the gate of the driving transistor, a gate of the fourth switching transistor receives the signal on the light emitting control line, and a second electrode of the fourth switching transistor is connected to the first terminal of the storage capacitor and the second electrode of the fifth switching transistor.

10. The display device according to claim 9, wherein the first power supply signal is an operating voltage for light emitting ELVDD, the second power supply signal is an earth voltage for light emitting ELVSS, and a high level of ELVSS is higher than a driving voltage corresponding to a highest gray scale of OLED.

11. The display device according to claim 9, wherein the first switching transistor, the second switching transistor, the third switching transistor, the fourth switching transistor, the fifth switching transistor and the driving transistor are selected individually from any one of a poly silicon TFT, amorphous silicon TFT, Oxide TFT and Organic TFT.

12. The display device according to claim 9, wherein the first switching transistor, the second switching transistor, the third switching transistor, the fourth switching transistor, the fifth switching transistor and the driving transistor are N type TFTs, wherein the first electrode is a drain and the second electrode is a source.

13. A method for driving an AMOLED pixel unit comprising a compensating unit, a light emitting control unit, a driving transistor, a storage capacitor and an organic light emitting diode, wherein, the method comprises steps of:

during a compensating phase, activating a signal on a scan line to switch on the compensating unit, such that a signal on a data line is transmitted to a gate and a first electrode of the driving transistor and a reference power supply signal is transmitted to a first terminal of the storage capacitor at the same time; and during a light emitting phase, activating a signal on a light emitting control line and deactivating the signal on the scan line to switch on the light emitting control unit, such that a first power supply signal is transmitted to the first electrode of the driving transistor and the first terminal of the storage capacitor is connected to the gate of the driving transistor, and the organic light emitting diode is driven to emit light.

14. The method according to claim 13, wherein the compensating unit comprises: a first switching transistor, a third switching transistor, and a fifth switching transistor; wherein a gate of the first switching transistor receives the signal on the scan line, a first electrode of the first switching transistor receives the signal on the data line, and a second electrode of the first switching transistor is connected to a first electrode the third switching transistor and the first electrode of the driving transistor; a gate of the third switching transistor receives the signal on the scan line, and a second electrode of the third switching transistor is connected to the gate of the driving transistor and the light emitting control unit; a gate of the fifth switching transistor receives the signal on the scan line, a first electrode of the fifth switching transistor is connected to the reference power supply, and a second electrode of the fifth switching transistor is connected to the first terminal of the storage capacitor and the light emitting control unit the light emitting control unit comprises a second switching transistor and a fourth switching transistor; wherein a first electrode of the second switching transistor receives the first power supply signal, a gate of the second switching transistor receives the signal on the light emitting control line, and a second electrode of the second switching transistor is connected to the first electrode of the driving transistor; a first electrode of the fourth switching transistor is connected to the second electrode of the third switching transistor and the gate of the driving transistor, a gate of the fourth switching transistor receives the signal on the light emitting control line, and a second electrode of the fourth switching transistor is connected to the first terminal of the storage capacitor and the second electrode of the fifth switching transistor;

an anode of the organic light emitting diode is connected to a second terminal of the storage capacitor, and a cathode of the organic light emitting diode receives a second power supply signal;

wherein, in a case in which the first switching transistor, the second switching transistor, the third switching transistor, the fourth switching transistor, the fifth switching transistor and the driving transistor are N type TFTs, the first electrode is a drain and the second electrode is a source; and the method further comprises:

during the compensating phase, the signal on the scan line being at a high level to turn on the first switching transistor, the third switching transistor and the fifth switching transistor, such that the driving transistor is charged by the signal on the data line, and a voltage of the first terminal of the storage capacitor is set to a voltage of the reference power supply signal by the reference power supply;

during the light emitting phase, the signal on the light emitting control line being at a high level to turn on the second switching transistor and the fourth switching transistor, and the scan line being at a low level, such that the storage capacitor keeps its stored electric charges unchanged and the driving transistor drives the organic light emitting diode to emit light.

15. The method according to claim 14, wherein the first power supply signal is an operating voltage for light emitting ELVDD, the second power supply signal is an earth voltage for light emitting ELVSS, and a high level of ELVSS is higher than a driving voltage corresponding to a highest gray scale of OLED.

* * * * *